US010435240B1

(12) United States Patent
Stroop

(10) Patent No.: US 10,435,240 B1
(45) Date of Patent: Oct. 8, 2019

(54) YARD WASTE BAG HOLDING DEVICE

(71) Applicant: Curtis A. Stroop, Sarasota, FL (US)

(72) Inventor: Curtis A. Stroop, Sarasota, FL (US)

( * ) Notice: Subject to any disclaimer, the term of this patent is extended or adjusted under 35 U.S.C. 154(b) by 0 days.

(21) Appl. No.: 16/145,353

(22) Filed: Sep. 28, 2018

Related U.S. Application Data

(63) Continuation-in-part of application No. 15/612,415, filed on Jun. 2, 2017, now abandoned.

(51) Int. Cl.
*B65F 1/14* (2006.01)
*B65B 67/12* (2006.01)

(52) U.S. Cl.
CPC ..... *B65F 1/1415* (2013.01); *B65F 1/1473* (2013.01); *B65B 67/1205* (2013.01); *B65B 67/1233* (2013.01); *B65F 2240/138* (2013.01)

(58) Field of Classification Search
CPC ..... B65F 1/1415; B65F 1/1468; B65F 2240/138; B65B 67/1205; B65B 67/1211; B65B 67/1233; F16B 2/20; F16M 11/38; F16M 11/42; F16M 2200/068; F16M 2200/08
USPC ..... 248/97–101
See application file for complete search history.

(56) References Cited

U.S. PATENT DOCUMENTS 733,449 A * 7/1903 Willsie ..... B65B 1/22 141/314
998,291 A * 7/1911 Heyd ..... B65F 1/1415 248/101
999,406 A * 8/1911 Skelton ..... B65B 67/12 248/100
1,121,388 A * 12/1914 Milks ..... B65F 1/1415 220/481
1,390,346 A * 9/1921 Durkee ..... B62B 1/14 248/100
1,718,962 A * 7/1929 Kimball ..... B62B 1/12 280/14
3,261,545 A * 7/1966 Frazier ..... B65F 1/06 232/43.2
3,468,505 A * 9/1969 Reilly ..... B65B 67/12 211/84
3,666,283 A * 5/1972 Stevens ..... B62B 1/26 280/645
3,697,030 A 10/1972 Schultz
3,744,081 A 7/1973 Miller
3,773,286 A * 11/1973 Govoni ..... B65B 67/12 248/150
3,797,847 A * 3/1974 Lindsey ..... B62B 1/12 248/98
3,870,261 A * 3/1975 McSwain ..... B65B 67/12 248/101
4,006,928 A 2/1977 Beugin
4,238,868 A * 12/1980 Sternberg ..... B65B 67/12 15/257.4
4,357,728 A * 11/1982 Pravettone ..... A47L 13/52 141/108
4,369,987 A * 1/1983 Witherell ..... A47C 13/00 248/166
4,448,434 A * 5/1984 Anderson ..... B62B 1/12 224/915
4,697,835 A 10/1987 Scott
(Continued)

*Primary Examiner* — Nkeisha Smith
(74) *Attorney, Agent, or Firm* — Livingston Loeffler, P.A.; Edward M. Livingston, Esq.; Bryan L. Loeffler, Esq.

(57) ABSTRACT

A yard waste bag holding device (1) for retaining a yard waste bag (3) in an open configuration so that it may more easily be filled with yard waste.

10 Claims, 3 Drawing Sheets

(56) References Cited

U.S. PATENT DOCUMENTS 4,759,518 A * 7/1988 Yardas ..... B65B 67/12 24/462
4,848,709 A * 7/1989 Kiniry ..... B65B 67/1244 248/101
4,899,967 A * 2/1990 Johnson ..... B65B 67/12 248/97
4,917,393 A * 4/1990 Rogers ..... B62B 1/12 248/129
4,927,104 A * 5/1990 Miller ..... B65B 67/1205 248/150
4,955,566 A * 9/1990 Bolich ..... B65B 67/1222 248/101
4,971,274 A * 11/1990 Mitchell ..... B65B 67/1233 248/101
5,035,438 A * 7/1991 Cronquist ..... B62B 3/104 248/129
5,040,754 A 8/1991 Dearman
5,048,712 A * 9/1991 Wolters ..... B65F 1/1415 220/262
5,232,274 A * 8/1993 Johan ..... B65F 1/1415 248/101
5,316,060 A 5/1994 Hodgdon et al.
5,456,431 A * 10/1995 Ilnisky ..... B62B 3/02 248/150
5,518,212 A * 5/1996 Sigler ..... B65B 67/1233 248/101
5,570,862 A * 11/1996 Nugent ..... B65B 67/1205 248/101
5,738,315 A 4/1998 Kent, Jr.
5,836,553 A * 11/1998 Bergaila ..... B65B 67/1233 248/99
5,913,496 A * 6/1999 Valdez ..... B65B 67/1233 24/461
5,947,492 A * 9/1999 Hallberg, Jr. ..... B62B 1/002 248/98
6,042,063 A * 3/2000 Kerr ..... B65B 67/1227 248/100
6,116,549 A * 9/2000 Santa Cruz ..... B65B 67/12 248/97
6,352,225 B1 * 3/2002 Dooley ..... B62B 3/106 220/908
6,382,573 B1 * 5/2002 Cepeda ..... B65B 67/1205 248/150
6,416,023 B1 * 7/2002 Satsky ..... B65B 67/12 248/99
6,491,264 B1 * 12/2002 Valesquez ..... B65B 67/1205 248/97
6,536,488 B1 * 3/2003 Pochobradsky .... B65B 67/1238 141/390
6,578,856 B2 * 6/2003 Kahle ..... B23D 57/0092 108/119
6,666,465 B2 12/2003 Chan
6,679,462 B1 * 1/2004 Valdez ..... B65B 67/1211 248/101
6,817,581 B1 * 11/2004 McAllister ..... B65B 67/1238 248/95
6,880,851 B1 * 4/2005 Summers ..... B62B 1/266 280/43.1
7,131,552 B2 * 11/2006 Simonson ..... B65F 1/06 220/485
7,222,825 B2 * 5/2007 Gilbert ..... B65F 1/1415 141/391
7,284,732 B1 * 10/2007 Lopa ..... B65B 67/1233 248/101
7,472,727 B1 * 1/2009 Sherrard ..... B65B 67/04 141/10
7,543,716 B2 * 6/2009 Lin ..... B65F 1/06 141/391
7,686,260 B1 3/2010 Tetradis
7,703,723 B1 * 4/2010 Cooper ..... B65B 67/1205 248/97
7,753,322 B1 * 7/2010 Peterson ..... B65F 1/1415 248/100
7,975,732 B2 * 7/2011 Schoniger ..... B65B 67/1233 141/10
8,091,840 B1 * 1/2012 Ortiz-Torres ..... B65B 67/1205 248/97
8,109,477 B1 * 2/2012 Blasbalg ..... B65F 1/004 248/101
8,322,663 B2 12/2012 Bosik
8,464,994 B2 * 6/2013 Chiu ..... B25H 1/04 144/286.1
8,608,188 B2 * 12/2013 Goldszer ..... B62B 1/008 280/651
8,720,833 B2 * 5/2014 Jack ..... B65B 67/04 248/100
8,882,060 B2 * 11/2014 Vaughn ..... B65F 1/10 141/390
8,910,970 B2 * 12/2014 Chen ..... B25H 1/04 280/652
8,919,708 B1 * 12/2014 Graves ..... B65F 1/1415 141/390
9,033,291 B2 * 5/2015 Branham ..... B65B 67/1211 248/100
9,089,318 B2 * 7/2015 Henniges ..... B62B 3/106
9,850,065 B2 * 12/2017 Decker ..... B65F 1/1426
9,902,518 B1 * 2/2018 Richardson ..... B65B 67/1205
9,988,172 B2 * 6/2018 Ristoski ..... B65B 67/1205
10,053,283 B1 * 8/2018 Stravitz ..... B65B 67/1233
2004/0140649 A1 * 7/2004 Faden ..... B62B 3/106 280/651
2005/0103950 A1 * 5/2005 Joubert ..... B62B 1/12 248/98
2007/0045483 A1 * 3/2007 Johnson ..... B65F 1/0006 248/99
2008/0191103 A1 * 8/2008 Thurgar ..... F16B 2/22 248/101
2008/0309038 A1 12/2008 Gilligan
2009/0230258 A1 * 9/2009 McFadden ..... B65B 67/1233 248/101
2010/0108826 A1 * 5/2010 Fernandez ..... B65F 1/10 248/98
2010/0140423 A1 * 6/2010 Davies ..... B65F 1/1415 248/101
2010/0200709 A1 * 8/2010 Wilkinson ..... B65B 67/1238 248/99
2010/0229767 A1 * 9/2010 Chiu ..... A47B 31/04 108/115
2011/0284703 A1 11/2011 Auguste
2012/0001036 A1 * 1/2012 Santiago ..... B65B 67/1233 248/101
2012/0325984 A1 * 12/2012 Moynihan ..... B65B 31/048 248/98
2014/0217247 A1 * 8/2014 Kemmer ..... B65B 67/1205 248/98
2015/0108888 A1 * 4/2015 Galimberti ..... B65F 1/0073 312/270.3
2015/0203292 A1 * 7/2015 Huff ..... B65F 1/14 220/86.1
2017/0113826 A1 * 4/2017 Ristoski ..... B65B 67/1205

* cited by examiner

YARD WASTE BAG HOLDING DEVICE

FIELD OF THE INVENTION

The present invention relates to bag holding devices and more particularly pertains to a new bag holding device for retaining a yard waste bag in an open configuration so that it may more easily be filled with yard waste.

BACKGROUND OF THE INVENTION

Large plastic or other fabric bags are widely used for collecting and discarding leaves, grass trimmings and other garden and lawn debris. However, plastic or other flexible collection bags are extremely difficult for a single worker to both hold the mouth of the bag open and to rake leaves into the bag or otherwise fill it. Some attempts have been made to provide frames for temporarily supporting the bag with the mouth open.

Therefore, a need exists for a bag holding device for retaining a yard waste bag in an open configuration so that it may more easily be filled with yard waste.

SUMMARY OF THE INVENTION

The primary object of the present invention is to provide a yard waste bag holding device for retaining a yard waste bag in an open configuration so that it may more easily be filled with yard waste.

The present invention fulfills the above and other objects by providing a yard waste bag holding device having a substantially rectangular-shaped retention frame that secures an opening of a yard waste bag to the holding device. The retention frame is perpendicularly attached to an upper edge of a side frame and/or side panel. A base panel is perpendicularly attached to a bottom edge of the side frame and/or side panel. The base panel and side panel protect the yard waste bag from making contact with the ground. The base panel provides support for the bottom of the yard waste bag to rest on when the bag holding device is in an upright position and the side panel provides support for the side of the yard waste bag when the holding device is placed in a horizontal position. The base panel and retention frame, respectively, are preferably hingedly attached to the side frame and/or side panel are so the holding device can be folded flat for storage.

A yard waste bag is preferably held in place around the perimeter of the retention frame by a clamping mechanism, such as a binder that fits over the retention frame, one or more tabs, clips and/or so forth. Wheels may be located on the holding device for rolling a trash bag and contents around a yard. A funnel may be provided to make it easier to rake leaves and other yard debris through the retention frame and into the yard waste bag.

The above and other objects, features and advantages of the present invention should become even more readily apparent to those skilled in the art upon a reading of the following detailed description in conjunction with the drawings wherein there is shown and described illustrative embodiments of the invention.

BRIEF DESCRIPTION OF THE DRAWINGS

In the following detailed description, reference will be made to the attached drawings in which.

DESCRIPTION OF THE PREFERRED EMBODIMENTS

Figure 1:
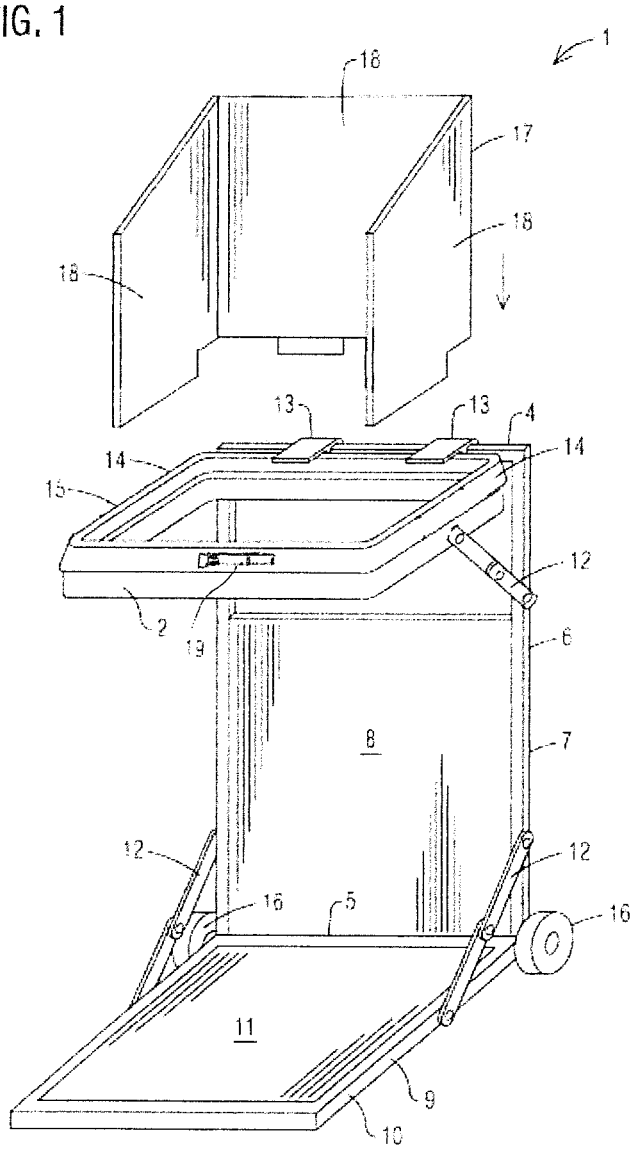
FIG. 1 is a perspective side view of a yard waste bag support of the present invention in an open position.
Figure 2:
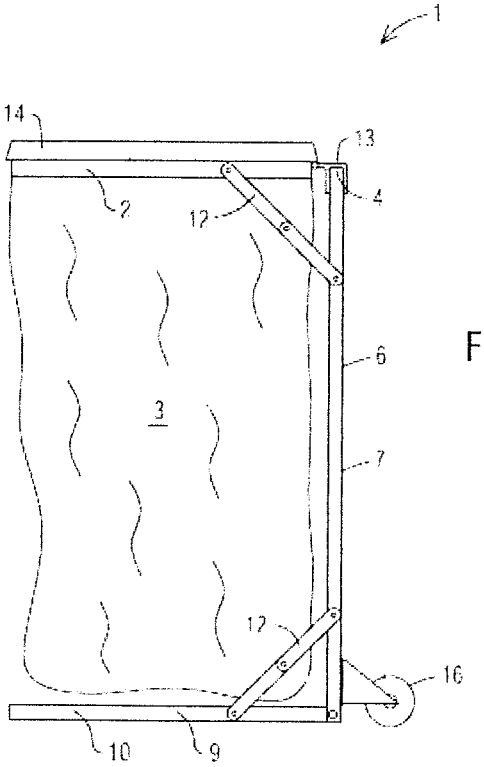
FIG. 2 is a side view of a yard waste bag support of the present invention in an open position and in use.
Figure 4:
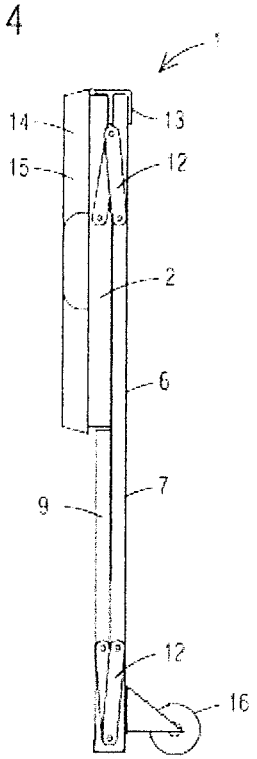
FIG. 4 is a side view of a yard waste bag support of the present invention in a closed position.

For purposes of describing the preferred embodiment, the terminology used in reference to the numbered accessories in the drawings is as follows:

1. holding device, generally
2. retention frame
3. yard waste bag
4. upper edge of side support structure
5. bottom edge of side support structure
6. side support structure
7. side frame
8. rigid side panel
9. base support structure
10. base frame
11. rigid base panel
12. cross arm
13. clip
14. clamping means
15. binder
16. wheel
17. funnel
18. funnel panel
19. latch With reference to FIGS. 1-7, the bag holding device 1 of the present invention comprises a substantially rectangular-shaped retention frame 2 that secures an opening of a yard waste bag 3 to the holding device 1. The retention frame 2 is perpendicularly attached to an upper edge 4 of a rectangular-shaped side support structure 6 comprising a rectangular-shaped side frame 7 and a rigid side panel 8 supported by the rectangular-shaped side frame 7. A rectangular-shaped base support structure 9 comprises a rectangular-shaped base frame 10 and a rigid base panel 11 supported by the rectangular-shaped base frame 10, which is perpendicularly attached to a bottom edge 5 of the side support structure 6. The rigid base panel 11 is a rigid panel that protects the yard waste bag 3 from making contact with the ground when the holding device 1 is in an upright position, thereby preventing the bag from becoming torn and/or punctured. The rigid side panel 8 protects the yard waste bag 3 from making contact with the ground when the holding device 1 is in a horizontal position, thereby preventing the bag from becoming torn and/or punctured.

The base support structure 9 and the retention frame 2, respectively, are both preferably hingedly attached to the side support structure 6 so the holding device 1 can be folded flat for storage and supported by cross arms 12 that lock the base support structure 9 and the retention frame 2, respectively, both into open positions. In addition, base support structure 9 and the retention frame 2, respectively, may be further secured to the side support structure 6 via one or more clips 13 that allow the base support structure 9 and/or the retention frame 2 to partially detach from the side support structure 6 when folding the holding device 1 into a closed position.

Figure 5:
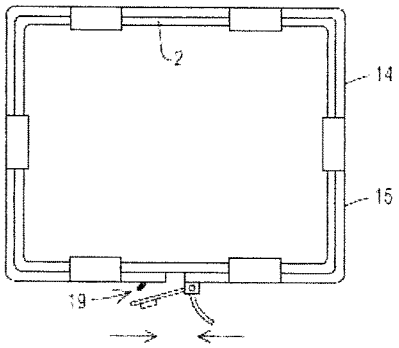
FIG. 5 is a top view of a clamping means being secured to the retention frame.

The yard waste bag 3 is preferably held in place around the perimeter of the retention frame 2 by a clamping means 14, such as a binder 15 that fits over the retention frame 2, one or more tabs, clips and/or so forth. The clamping means 14 may be secured to the retention frame 2 via a pressure fit or by a latch 19 that tightens the binder 15 around the retention frame 2, as illustrated in FIG. 5. The retention frame 2 may have an outer non-slip surface, such as rubber. Likewise, binder 15 may have an outer non-slip surface.

Figure 3:
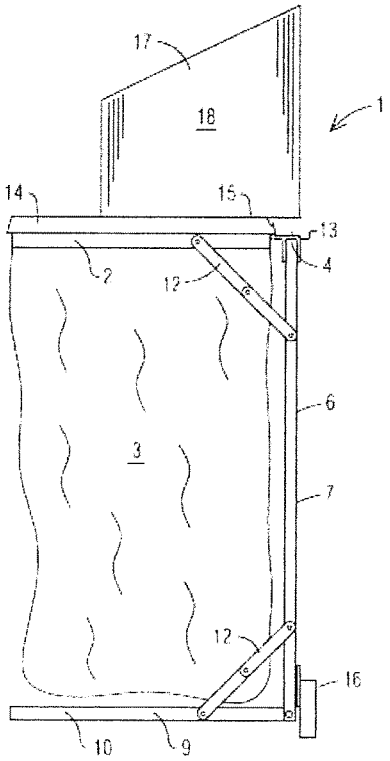
FIG. 3 is a side view of a yard waste bag support of the present invention in an open position and having the wheels folded flat.

Wheels 16 may be located on the holding device 1 for rolling the holding device 1, yard waste bag 3 and contents around a yard as the yard waste bag 3 rests on the rigid side panel 8 and/or rigid base panel 11. The wheels may be attached in a fixed position or may be foldable wherein the wheels 16 may be folded outward or inward so that they are parallel with the rigid side panel 8, thereby allowing the holding device 1 to be laid completely flat in a horizontal position in relation to the ground, as illustrated in FIG. 3.

Figure 6:
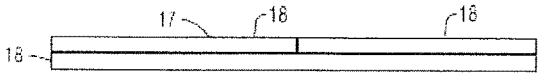
FIG. 6 is a side bottom view of a funnel of the present invention in a folded position.

A funnel 17 may be provided to make it easier to rake leaves and other yard debris through the retention frame 2 and into the yard waste bag 3. As illustrated in FIG. 1, the funnel 17 comprises three foldable panels 18 that fold outward into a rectangular shape and is insertable into the retention frame 2. The funnel 17 may be folded into a flat configuration for storage and transportation, as illustrated in FIG. 6. The funnel may have tabs along lowered edges to allow the funnel to be inserted into the retention frame 2 while being offset to lay flat on the ground parallel and flush with the side support structure 6.

It is to be understood that while a preferred embodiment of the invention is illustrated, it is not to be limited to the specific form or arrangement of parts herein described and shown. It will be apparent to those skilled in the art that various changes may be made without departing from the scope of the invention and the invention is not to be considered limited to what is shown and described in the specification and drawings.

Having thus described my invention, I claim:

1. A yard waste bag holding device comprising:

a rectangular-shaped retention frame that secures an opening of the yard waste bag to the holding device;

said rectangular-shaped retention frame being perpendicularly attached to an upper edge of a side support structure;

a base support structure perpendicularly attached to a bottom edge of the side support structure;

said side support structure comprises a rectangular-shaped side frame that supports a rectangular-shaped rigid side panel that protects the yard waste bag from making contact with the ground when the holding device is in a horizontal position;

said base support structure comprises a rectangular-shaped base frame and rectangular-shaped rigid base panel that protects the yard waste bag from making contact with the ground when the holding device is in a vertical position; and said rectangular-shaped retention frame is secured to the side support structure by at least one clip that allows the rectangular-shaped retention frame to partially detach from the side support structure when folding the holding device into a closed position.

2. A yard waste bag holding device comprising:

a rectangular-shaped retention frame that secures an opening of the yard waste bag to the holding device;

said rectangular-shaped retention frame being perpendicularly attached to an upper edge of a side support structure;

a base support structure perpendicularly attached to a bottom edge of the side support structure;

said side support structure comprises a rectangular-shaped side frame that supports a rectangular-shaped rigid side panel that protects the yard waste bag from making contact with the ground when the holding device is in a horizontal position;

said base support structure comprises a rectangular-shaped base frame and rectangular-shaped rigid base panel that protects the yard waste bag from making contact with the ground when the holding device is in a vertical position; and said base support structure is secured to the side support structure by at least one clip that allows the base support structure to partially detach from the side support structure when folding the holding device into a closed position.

3. A yard waste bag holding device comprising:

a rectangular-shaped retention frame that secures an opening of the yard waste bag to the holding device;

said rectangular-shaped retention frame being perpendicularly attached to an upper edge of a side support structure;

a base support structure perpendicularly attached to a bottom edge of the side support structure;

said side support structure comprises a rectangular-shaped side frame that supports a rectangular-shaped rigid side panel that protects the yard waste bag from making contact with the ground when the holding device is in a horizontal position;

said base support structure comprises a rectangular-shaped base frame and rectangular-shaped rigid base panel that protects the yard waste bag from making contact with the ground when the holding device is in a vertical position;

said base support structure is hingedly attached to the side support structure;

said rectangular-shaped retention frame is hingedly attached to the side support structure;

two wheels located on the holding device for rolling the holding device; and said two wheels being foldable wherein each of the two wheels may be folded into a position that is parallel with the rigid side panel, thereby allowing the holding device to be laid completely flat in a horizontal position in relation to the ground.

4. The yard waste bag holding device of claim 3 further comprising:

a rectangular-shaped binder for holding the yard waste bag in place on the rectangular-shaped retention frame wherein said rectangular-shaped binder engages an entire perimeter of the rectangular-shaped retention frame, thereby sandwiching an upper edge surrounding an opening of the yard waste bag between the rectangular-shaped binder and the rectangular-shaped retention frame.

5. The yard waste bag holding device of claim 3 further comprising:

at least one cross aim that locks the base support structure into an open position.

6. The yard waste bag holding device of claim 3 further comprising:

at least one cross arm that locks the retention frame into an open position.

7. The yard waste bag holding device of claim 3 further comprising:

said rectangular-shaped retention frame is secured to the side support structure by at least one clip that allows the rectangular-shaped retention frame to partially detach from the side support structure when folding the holding device into a closed position.

8. The yard waste bag holding device of claim 3 further comprising:

said base support structure is secured to the side support structure by at least one clip that allows the base support structure to partially detach from the side support structure when folding the holding device into a closed position.

9. The yard waste bag holding device of claim 3 further comprising:

a funnel that is insertable into the rectangular-shaped retention frame.

10. The yard waste bag holding device of claim 9 wherein:

said funnel comprises three foldable panels that fold outward into a rectangular shape and is insertable into the retention frame.

* * * * *